United States Patent [19]

Connor

[11] Patent Number: 4,724,863

[45] Date of Patent: Feb. 16, 1988

[54] FLUE GAS SEAL

[76] Inventor: Peter J. Connor, 2510 Fifth Ave., Bath, Pa. 18017

[21] Appl. No.: 53,136

[22] Filed: May 21, 1987

[51] Int. Cl.[4] ..... F16K 3/02; F16K 3/312; F16K 25/00

[52] U.S. Cl. ..... 137/240; 126/285 A; 138/94.3; 251/174; 251/328; 277/236

[58] Field of Search ..... 137/240; 126/285 A, 126/285 B; 138/94.3; 251/172, 174, 176, 326, 327, 328, 329, 129.11; 277/235 R, 236

[56] References Cited

U.S. PATENT DOCUMENTS

| | | | |
|---|---|---|---|
| 3,504,883 | 4/1970 | Beck | 251/172 |
| 4,022,241 | 5/1977 | Fox | 137/240 |
| 4,054,261 | 10/1977 | Gilmore et al. | 251/172 |
| 4,088,146 | 5/1978 | Hagar | 251/174 |
| 4,093,245 | 6/1978 | Connor | 126/285 A |
| 4,176,673 | 12/1979 | Connor | 137/240 |
| 4,278,236 | 7/1981 | Janich | 251/174 |
| 4,334,550 | 6/1982 | Connor et al. | 137/240 |
| 4,491,144 | 1/1985 | Dreyer et al. | 126/285 A |
| 4,561,472 | 12/1985 | Dreyer et al. | 137/240 |
| 4,615,505 | 10/1986 | Anson et al. | 251/174 |

*Primary Examiner*—George L. Walton
*Attorney, Agent, or Firm*—Ratner & Prestia

[57] ABSTRACT

A damper mechanism of the slide gate type includes two curved seal segments positioned in back-to-back abutting relation to function as the primary flue seal. A seal door when closed extends between the upper ends of the seal segments and applies compression to the spaced appart ends to form, in combination with the seal segments, a closed chamber which functions as a secondary seal. Means are provided for applying a thrust force to the upper end of one of the seal segments to move that seal segment into abutting relation with the other seal segment when the slide gate is withdrawn. In a preferred embodiment, the thrust force is applied by the seal door during its closing. In another preferred embodiment, the closed chamber formed by the seal door and seal segments is enlarged and compressed air is pumped into the chamber to improve its functioning as a secondary seal. The seal door when in closed position, and the slide gate when in lowered position, apply a static downward and inward compressive force to the seal segments which results in self-adjustment of the seal segments in response to distortion generated by thermal, chemical or mechanical forces.

15 Claims, 7 Drawing Figures

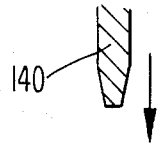
Fig. 5A
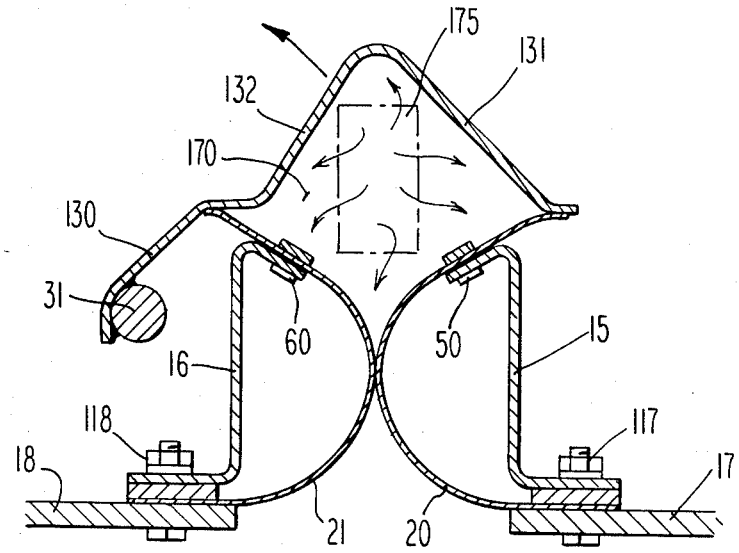
Fig. 5B
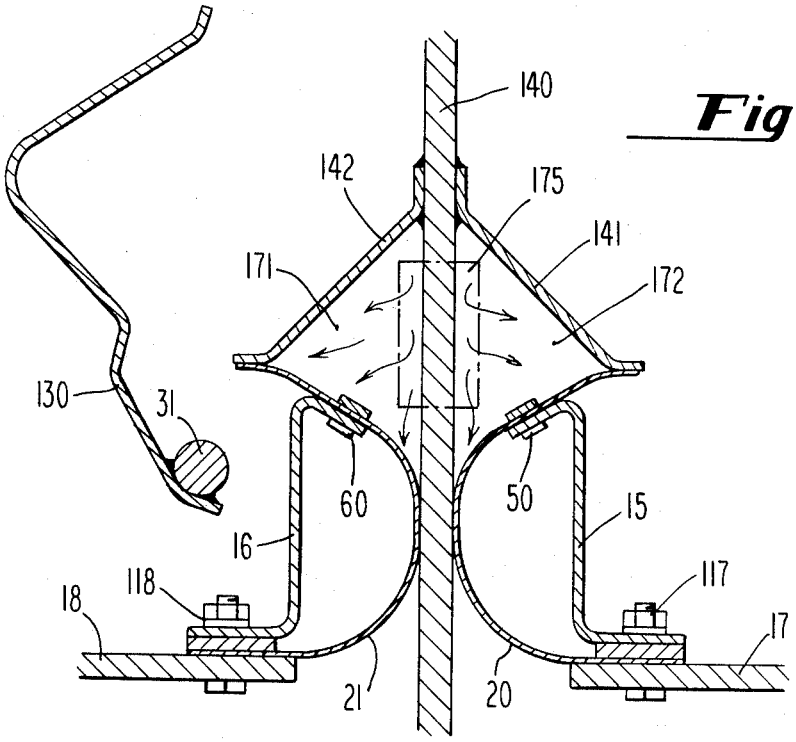

FLUE GAS SEAL

FIELD OF THE INVENTION

This invention relates to sealing mechanisms for flat sliding blade or sliding gate dampers used to isolate the flow of fluid, usually a gaseous fluid, in a duct, conduit or other housing. Such dampers are sometimes referred to as guillotine dampers. In the present application the term sliding gate damper will be used.

For prior art patents in this field see Lowe, et al U.S. Pat. No. 3,228,389; Beck U.S. Pat. No. 3,504,883; Fox U.S. Pat. No. 4,022,241; Gilmore, et al U.S. Pat. No. 4,054,261; Hagar U.S. Pat. No. 4,088,146; Connor U.S. Pat. No. 4,176,673; Dreyer, et al U.S. Pat. No. 4,491,144; Anson, et al U.S. Pat. No. 4,615,505; Hagar U.S. Pat. No. 4,191,212; and Janich U.S. Pat. No. 4,278,236.

BACKGROUND OF THE INVENTION

In flat sliding gate dampers, the duct or housing has an aperture in one or more of its walls into which the flat blade or gate is slidingly inserted to provide a barrier to the flow of the gaseous fluid through the housing. Sealing means are provided to avoid leakage of the gas through the closed gate and into the ambient atmosphere. Such sealing means must be effective both in the open and also in the closed positions of the damper. It is known to provide, as a sealing means, a pair of resilient curved diaphragms or seal segments positioned in back-to-back relationship, with the curved segments, in response to spring tension, pressing against the slide gate when the gate is in its inserted position, and pressing against one another when the slide gate is withdrawn. Seal segments of this type rely on the sustained resilience of the spring metal or other material of which the seal segments are made. It has been found however that after repeated usage, over extended periods of time, the seal segment material loses its resilience and as a result, when the seal gate is withdrawn, the two seal segments no longer spring back into tight leak-free engagement with one another. Moreover, if the slide gate accumulates on its surface particulate matter, as is frequently the case in precipitator usage, a very strong spring tension is required to maintain the seal segments in tight leak-free engagement with the roughened uneven surface of the slide gate. As a result there is leakage even when the slide gate is in its down or inserted position.

SUMMARY OF THE INVENTION

According to the present invention, a slide gate damper mechanism is provided which includes means for physically pushing one of two opposing curved seal segments into tight leak-free engagement with the other, following withdrawal of the slide gate.

In a preferred embodiment, a seal door is provided and the closing of the seal door provides the thrust force which pushes the one seal segment into engagement with the other.

In another embodiment, the seal door when closed, and the slide gate when lowered, provide in combination with the curved seal segments, an air-tight chamber thereby to provide a secondary sealing for the damper mechanism. In a preferred embodiment, pressurized air is pumpe into the chamber.

In each of the preferred embodiments, a static thrust force or static pressure is applied, by the door when in closed position and by the slide gate when in its DOWN position, to upper ends of the seal segments maintaining the seal segments in sealing engagement with each other, or with the slide gate when DOWN, thereby to provide self-adjusting compensation, or constant surveillance to adjust, for distortion in shape or dimensions of the slide gate or conduit due to high temperature or other stresses.

BRIEF DESCRIPTION OF THE DRAWING

FIG. 5A is a view generally similar to FIG. 2A but showing, in closed position, a seal door having a different shape to define an enlarged chamber for the pressurized sealing air.

FIG. 5B is a view similar to FIG. 5A but showing the seal door in open position.

DETAILED DESCRIPTION OF THE PREFERRED EMBODIMENTS

Figure 1:
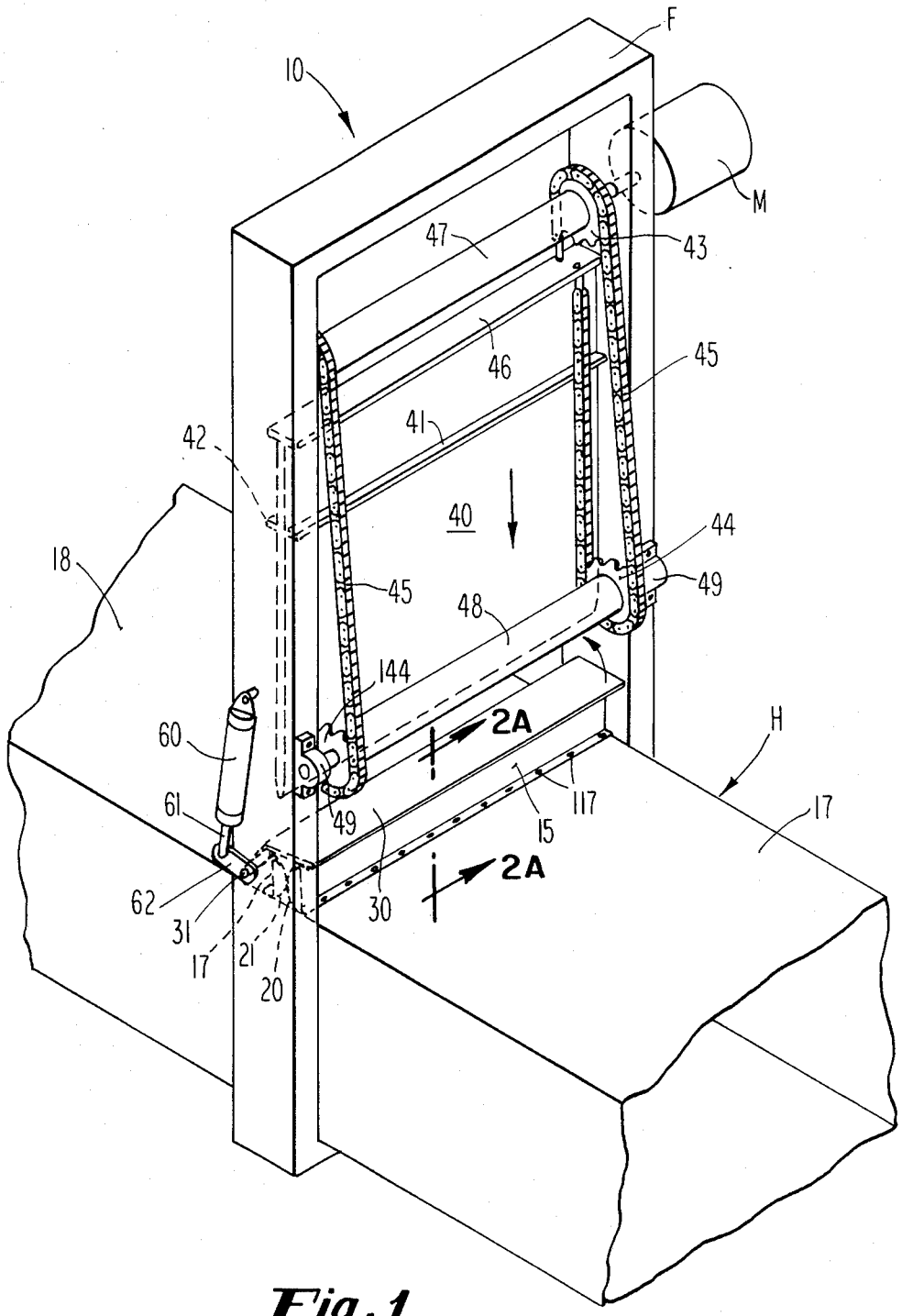
FIG. 1 is a perspective illustration of a damper mechanism into which the improvement of the present invention is incorporated.

FIG. 1 shows a metal or conduit housing H for a fluid, typically a gas, and a metal damper mechanism 10 for controlling the flow of the gas. The damper mechanism is of the sliding gate or guillotine type and includes a frame F which supports a slide gate 40 for sliding movement up and down in the frame. This movement may be controlled, so far as the present invention is concerned, by any suitable mechanism. In FIG. 1 a pair of sprocket-and-chain mechanisms are shown, one at each side of the frame F. At one side, one end of sprocket chain 45 is connected to an upper end plate 46 of slide gate 40. The chain 45 is trained over an upper sprocket 43, then downward and around a lower sprocket 44, then upward, and is connected at its end to the underside of end plate 46. A similar chain 145, similarly trained, is mounted at the opposite side of the frame F. The upper sprockets 43,143 are mounted on a drive roller 47 which may be driven by any suitable means. An electric motor M is shown in FIG. 1. The lower sprockets 44,144 are mounted on an idler roll 48. Both rollers 47 and 48 are journaled for rotation is suitable bearing mountings 49 on frame F.

When the flow of gas through the duct or housing H is to be shut off, or otherwise restricted, a seal door 30, provided in accordance with the present invention, is pivotally raised by any suitable mechanism. In FIG. 1, a pneumatic cylinder 60 is shown. Actuation of cylinder 60 extends piston 61 which moves link 62 counterclockwise (as viewed in FIG. 1) and causes pivot rod 31 of seal door 30 to rotate on its own axis, thereby opening the door 30. The slide gate 40 may then be lowered between the opposing curved seal segments 20,21.

Figure 2A:
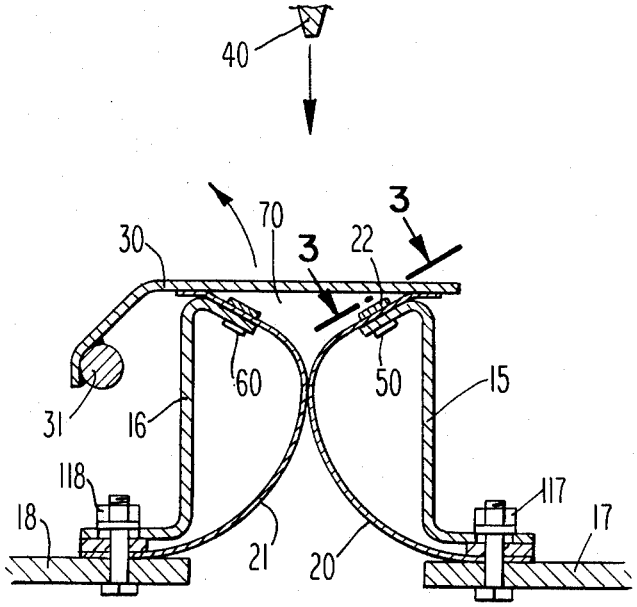
FIG. 2A is a view, in section, looking along the line 2A—2A of FIG. 1 showing the damper mechanism with the seal door in closed position.
Figure 2B:
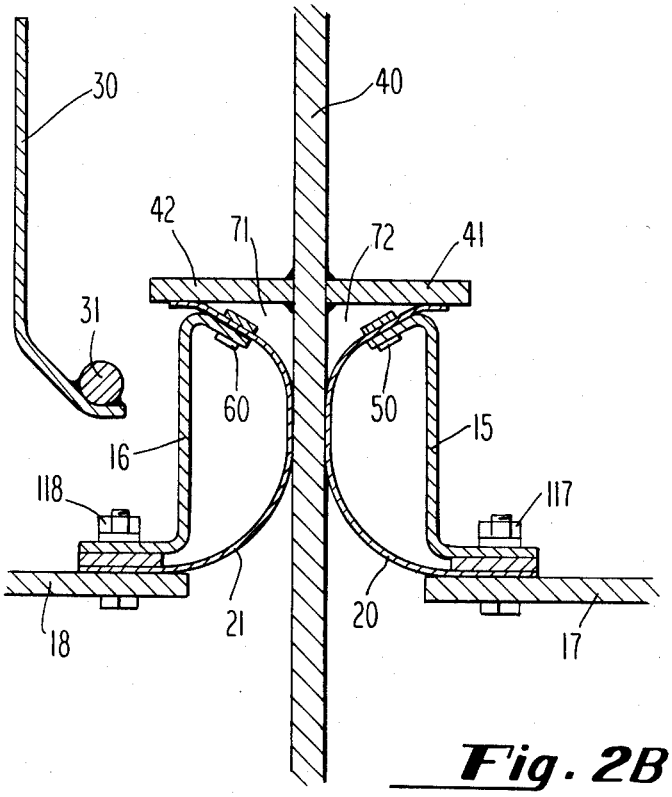
FIG. 2B is a view, in section, similar to that of FIG. 2A but showing the seal door in open position and the slide gate in closed or DOWN position.

Reference is now made to FIG. 2A and FIG. 2B. In FIG. 2A the seal door 30 is in closed position. In FIG. 2B, seal door 30 has been opened and slide gate 40 has been lowered through seal segments 20,21 into the duct or housing H. Seal segments 20,21 are resilient metal such as spring-tempered steel. As seen in the drawing, seal segments 20,21 are arcuate or curved and, in FIG. 2A, are positioned in back-to-back abutting relationship. The lower ends of seal segments 20, 21 are anchored to the spaced-apart top plates 17,18 of the housing H by anchor bolts 117,118. Also anchored to the top plates 17,18 by the same anchor bolts are the lower ends of upstanding seal-segment retainer bars 15,16. The upper ends of retainer bars 15,16 are bent toward each other to receive and support the upper end portions of opposing seal segments 20,21. The seal segments 20,21 are secured at their upper end portions to the retainer bars 15,16 by a plurality of spaced-apart shoulder-pin fastening mechanisms 50,60, one of which is shown in detail in FIG. 4 and which will be described below.

Figure 3:
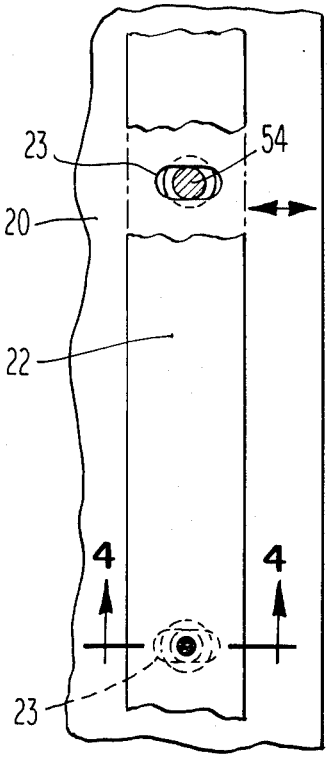
FIG. 3 is a view looking down along the line 3—3 of FIG. 2A.
Figure 4:
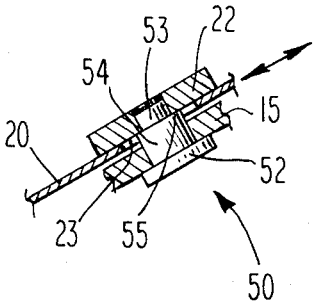
FIG. 4 is a view, in section, looking along the line 4—4 of FIG. 3.

As seen in FIGS. 3 and 4, each of the seal segments 20,21 is provided with a number of slots 23 through each of which pass the upper small-diameter nose portion 53 of one of the shoulder pins 50. Pin 50 has an enlarged-diameter lower end portion 52 which bears against retainer bar 15. Between the lower end portion 52 and the nose 53 is a collar 54 which functions as a spacer. Positioned above the collar 54, and supported on the shoulder 55 of the collar, is a flat plate 22 having holes therethrough just large enough to receive the nose 53 of the shoulder pin. The nose 53 of each of the shoulder pins is plug welded to the plate 22 as indicated in FIG. 4. Collar 54 provides spaced separation between the retainer bar 15 and the plate 22 for receiving the seal segment 20 and for allowing sliding movement of seal segment 20 relative to retainer bar 15 within the limits of the slots 23.

The mechanism 60 is a shoulder pin device identical to shoulder-pin device 50 and allows for sliding movement of seal segment 21 relative to retainer bar 16 within the limits of the slots 23 in the seal segment.

The operation of the damper mechanism illustrated in FIGS. 2A and 2B will now be described. At the time of initial installation, the slide gate 40 is in its UP or withdrawn position as illustrated in FIG. 2A. Seal door 30 is open, as shown in FIG. 2B, and the installer adjusts the seal segments 20,21 to the positions shown in FIG. 2A making certain that each of the curved seal segments 20,21 comes into abuttment with the other at the vertical plane of the slide gate 40. The slide gate 40 is then lowered and its tapered lowered edge engages the curved seal segments 20,21 at their tangent point and separates the two seal segments, 20,21, pushing the left segment 21 to the left and pushing the right segment 20 to the right. The final positions are shown in FIG. 2B. Separation of the seal segments 20,21 from the abutting positions shown in FIG. 2A is allowed by sliding movement of the upper end edge portions of the seal segments in the shoulder pins 50,60. This sliding movement is of course within the limits allowed by the slots 23.

In accordance with the present invention, slide gate 40 is provided with lateral arms 41,42 so positioned that when the slide gate 40 is fully lowered in its DOWN position, lateral arms 41,42 are in compressive engagement with, and apply static downward pressure on, the upper end edge portions of the seal segments 20,21, as illustrated in FIG. 2B. Since the upper end edge portions of seal segments 20,21 are inclined, the downward pressure of lateral arms 41,42 includes a component of static pressure which maintains the two seal segments 20,21 in tight sealing engagement with the slide gate 40. When gate 40 is withdrawn and the lateral arms 41,42 move upwardly out of engagement with the ends of seal segments 20,21, the seal segments do not move. They do not return to the abutting positions shown in FIGS. 2A. They remain in the spaced-apart positions in which they were placed by the slide gate 40. They remain in these positions because the tensile stress on the curved resilient seal segments urges their upper end edge portions upwardly against plate 22 at shoulder pins 50,60. This plate provides frictional resistance against sliding movement of the seal segments in the shoulder pins.

In accordance with the present invention, seal segments 20,21 can only be moved by thrust forces so applied as to have a force component in the plane of the seal segments. In short, the seal segments 20,21 may be moved by a force component which pushes inwardly on their upper ends, or by a force which pushes from the center or diaphragm portion of the seal segments outwardly toward the upper ends. But due to action of the shoulder pins 50,60 the seal segments will not move in response to tensile stress in the resilient material of which seal segments 20,21 are made.

Following withdrawal of the slide gate 40 to its UP position, the seal door 30 is closed, being moved from the open position shown in FIG. 2B to the closed position shown in FIG. 2A. In accordance with a preferred embodiment, during closing of seal door 30, the inner or under surface of the door comes into engagement with the upwardly-inclined upper end edge portion of the adjacent seal segment 21 and applies a downward and inward force thereto inwardly causing it to slidingly move inwardly in the shoulder pins 60 to the extent allowed by the slots 23. This inward movement is sufficient to cause the center or diaphragm portion of the seal segment 21 to come into tight leakfree engagement with the center or diaphragm portion of the other seal segment 20.

By the time seal door 30, upon closing, engages with the upper end edge portion of the more remote seal segment 20, the seal segment 21 has already been pushed into engagement with the diaphragm portion of segment 20. Thus, seal segment 20 does not change its position when the seal door is closed.

Closing of the seal door 30 imposes a compressive force on the upper ends of each of the seal segments 20,21. Thus, as seen in FIG. 2A, a closed chamber 70 is formed defined by the seal door 30 and the seal segments 20,21. This chamber 70 functions as a secondary seal. Similarly, when the slide gate 40 is fully inserted into its DOWN position, the lateral arms 41,42 of the slide gate 40 impose a compressive force of the upper end edge portions of each of the seal segments 20,21 and, as seen in FIG. 2B, cooperate with seal segments 20,21 to form a pair of closed chambers 71,72 which function as secondary seals.

When seal door 30 is opened from the closed position shown in FIG. 2A, seal segments 20,21 do not move. They remain in their abutting positions awaiting insertion of the slide gate 40. When the slide gate 40 is inserted between the abutting curved seal segments 20,21, the left seal segment 21 is moved leftward to the position shown in FIG. 2B. The right seal segment 20 does not change its position. This seal segment 20 is still in the position into which it was placed when the slide gate 40 was initially lowered during initial installation of the mechanism. In brief, once it is initially installed, the position of the right seal segment 20 does not change (unless a different slide gate of greater thickness is later installed).

It will be seen from the foregoing that the functioning of the damper seal is not dependent upon the resilience of the spring-metal material of which seal segments 20,21 are made and is not dependent upon the ability of the seal segments to return to tight sealing engagement with the other member of the pair when the slide gate is removed. Rather, in a preferred embodiment, each time the seal door is closed, the one seal segment 21 is pushed into tight sealing engagement with the other seal segment 20. The latter maintains the same position into which it was initially set during installation.

In a preferred embodiment, a seal door is provided which performs three functions. One, it provides a thrust force during closing to move one of the seal segments into abutting relation with the other. Two, it provides, when in closed position, a closed chamber 70 above the abutting seal segments which functions as a secondary seal. Three, when in closed position it provides static downward and inward pressure on the inclined ends of the seal segments. This provides self-adjustment of the seal segments in response to distortions due to thermal, chemical or mechanical forces.

A broad concept of the present invention does not require that the thrust force for moving seal segment 21 toward segment 20 be provided by the closing of the seal door. This thrust force could be supplied by other suitable means.

FIGS. 5A and 5B show alternate embodiments which relate to the sealing chambers which provide the secondary seal. In FIGS. 5A,5B seal segments 20,21 and the manner in which they are moved, is the same as has already been described with respect to FIGS. 2A and 2B. The difference between the mechanisms of FIGS. 2A,2B and the mechanisms of FIGS. 5A,5B is that the seal door 130 has a peaked shape so as to form, in combination with seal segments 20,21, an enlarged chamber 170. And, in FIG. 5B, the opposing arms 141,142 of the slide gate 140 project laterally downward at an angle of about 45° relative to the plane of the slide gate 140, thereby to divide chamber 170 into a pair of chambers 171,172 each larger than the chambers 71,72 formed by the lateral arms 41,42 in the FIG. 2B embodiment.

An advantage of the enlarged chamber 170 or 171,172 illustrated in FIGS. 5A,5B is that there is now sufficient space for the installation of an opening 175 in the side wall through which compressed air may be delivered into the chamber 170 or 171,172 thereby to provide an area having a pressure greater than that of the gas in the housing H, thereby providing additional sealing against leakage. The enlarged pressurized chambers shown in FIGS. 5A and 5B provide zero leakage and represent a preferred form of sealing, according to the present invention.

In some installations, in order to meet customer requirements for zero leakage to ambient, it may desirable to use the flat door 30 of FIG. 2A and the guillotine gate 140 of FIG. 5B thereby to provide an enlarged chamber for pressurized secondary sealing when the slide gate is in place.

So far as the present invention is concerned, any suitable means may be employed for lowering and raising the slide gate in timed relation with the opening and closing of the seal door. In the drawing, a pneumatic cylinder and piston 60,61 have been shown. A brief description of a more complete pneumatic system will now be given. In a suitable pneumatic system, air-tight limit switches would trigger a pneumatic solenoid which would control opening and closing of the door. The limit switches would be actuated by the slide gate. One limit switch would be actuated to close the seal door when the slide gate approached full open position. Another limit switch would be actuated to open the seal door when the slide gate started downward from full open position. Movement of the seal door could be accomplished either by pneumatic or by electrical means or by a combination thereof. Or mechanical linkage between the slide gate and the seal door could be used. For example, when the slide gate is pulled upwardly, the seal door is pulled by mechanical linkage to closed position, and when the slide gate is pushed down, the seal door is opened, as by spring tension.

To provide for the possibility that the slide gate 40 of FIGS. 2A,2B or slide gate 140 of FIGS. 5A,5B might, as a result of the shearing of a pin or the breaking of a linkage or for any other reason fall "free" in its track under gravitational force without resistance and without control, the seal door 30 of FIGS. 2A,2B or door 130 of FIGS. 5A,5B should preferably be opened at a sufficiently slow speed which is so related to the free fall speed of the gate that the free falling gate will strike the not yet fully opened door. The door should, of course, be designed and constructed of sufficient strength to absorb the force and to abort the free fall of the gate, preventing it from crashing through and beyond the flue duct. What has just been described is a safety feature which is of importance but which is not essential to the basic concept of the present invention.

As was indicated previously under the heading "Summary of the Invention", the damper mechanism provided by the present invention has a self-adjusting feature which is an important advantage. As described, the seal door 30 or 130 when in closed position and the slide gate 40 or 140 when in DOWN position apply a static downward pressure or compressive force on the upper end portions of seal segments 20,21. These upper end portions, before being compressed, are upwardly inclined at an acute angle relative to the horizontal. Thus the static downward and inward pressure provided by the closed door, or by the gate in DOWN position, develops a static force component in the incline plane of the upper end portion of each seal segment. This static force component developed by the door when closed maintains the seal segment 21 in compressive abutting relation with the other seal segment 20. And this static force component developed by the gate when in DOWN position, maintains the seal segments 21 and 20 in compressive abutting relation with the gate.

If, for example, due to thermal forces such as temperature, the gate 40 or 140 should increase in thickness or should warp or should otherwise thermally distort, the force created by such distortion should override the static force component applied by the lateral arms 41,42 or 141,142 and seal segments 21,20 will be moved outwardly, i.e., away from each other, but the compressive pressure on the sides of the gate 40 or 140 will remain constant.

Similarly, when seal door 30 or 130 is closed, if, for example due to mechanical or thermal distortion in the conduit structure, the spacing between elements 17 and 18 should change, the resulting change in the spacing between anchors 117 and 118 will be sensed by the upper and edge portions of seal elements 20,21 and these elements will move accordingly. If the movement of either of the seal elements 20,21 is outward, i.e., toward the opposite seal elements, however, the downward and inward compressive pressure applied by the seal door will maintain constant the compressant pressure on the abutting seal segments.

I claim:

1. A damper mechanism comprising:

(a) first and second curved seal segments of resilient material positioned in opposing back-to-back relationship;

(b) a slide gate adapted for sliding insertion between, and withdrawal from between, said curved seal segments;

(c) a seal door pivotally mounted adjacent said first seal segment and so positioned that upon pivotal movement toward a closed position said door comes into engagement with said first seal segment and only applies a thrust force thereto to move said first seal segment toward and into abutting and sealing engagement with said second seal segment and with said second seal segment remaining stationary thereby providing a fluid tight seal therebetween.

2. A damper mechanism according to claim 1 wherein said seal door during closing comes into engagement with an end portion of said first seal segment.

3. A damper mechanism according to claim 1 or 2 wherein, during insertion of said slide gate and when said door is open, said first seal segment is adapted to be pushed by said slide gate out of engagement with said second seal segment and toward said open door.

4. A damper mechanism according to claim 2 wherein fastening means are provided for maintaining said first and second seal segments stationary in response to forces developed by the resilience of said seal segment material.

5. A damper mechanism according to claim 2 wherein said first and second seal segments are formed of spring-metal material, wherein means are provided for anchoring one end of each of said first and second seal segments and wherein means are provided for opposing movement of the non-anchored ends of said secondary seal.

6. A damper mechanism according to claim 1 wherein said seal door is provided with a peak forming an enlarged area therebeneath, said peaked door cooperating with ends of said first and said second seal segments to form an enlarged closed chamber which functions as a secondary seal.

7. A damper mechanism according to claim 1 wherein said slide gate is provided with first and second arms extending therefrom in opposing directions and forming, in cooperation with said seal segments, chambers for receiving pressurized air to function as a secondary seal.

8. A damper mechanism comprising:

(a) first and second curved seal segments positioned in opposing back-to-back relationship;

(b) a slide gate damper for sliding insertion between, and withdrawal from between, said curved seal segments;

(c) a seal door pivotally mounted adjacent one of said seal segments and so positioned that upon being pivotally closed said seal door comes into engagement with an end edge portion of each of said seal segments and imposes a compressive force thereon regardless of whether or not said seal segments are in a sealing or non-sealing position with one another thereby creating in combination with said seal segments a closed chamber which functions as a secondary seal.

9. A slide gate damper mechanism comprising a first housing for gaseous fluid, said housing having an aperture in one of its walls, a flat gate positioned for sliding movement through said aperature between open and closed positions, said gate in closed position extending transversely into said housing to restrict the flow of fluid therethrough, and sealing means effective to seal said housing against fluid leakage at said aperture when said gate is in open and also when said gate is in its closed position, said sealing means comprising:

(a) first and second curved seal segments adapted to be positioned in abutting back-to-back relationship;

(b) anchor means anchoring one end of each of said seal segments to said housing;

(c) a pair of fixed retaining members each having one of its ends anchored to said housing and its other end adapted to support the unanchored end of one of said seal segments;

(d) fastening means at the unanchored end of each of said seal segments securing said seal segment to said retaining member while allowing sliding movement of said seal segments in said fastening means in response to exterior thrust force applied to said seal segments;

(e) said first of said seal segments being adapted to be moved and separated from said second in response to sliding movement of said gate therebetween from open into closed positioned, each at said seal segments adapted to remain in said separated position despite withdrawal of said gate from closed to open position;

(f) a seal door mounted for pivotal movement adjacent said first of said seal segments and having open and closed positions, said seal door in moving from open to closed position engaging the unanchored end edge of said first seal segment thereby to move said engaged seal segment slidingly through said fastening means and into abuttment with said second seal segment, said second seal segment remaining substantially stationary.

10. A slide gate damper mechanism according to claim 9 wherein said fastening means includes an upper retainer plate and a shoulder pin, said shoulder pin having a small diameter nose which is received in a hole in said retainer plate, said shoulder pin having a large diameter lower end which bears against said fixed retaining member, said pin having an intermediate collar portion which functions as a spacer and which has a shoulder on which said retainer plate rests, said seal segment being slidingly movable in the space provided by said collar between said fixed retaining member and said upper retainer plate.

11. A damper mechanism comprising:

a. first and second curved seal segments positioned in opposing back-to-back relationship;

b. a slide gate damper for sliding insertion between, and withdrawal from between, said curved seal segments;

c. a seal door pivotally mounted adjacent one of said seal segments and so positioned that upon being pivotally closed, said seal door comes into engagement with an end edge portion of each of said seal segments and imposes a downward and inward compressive force thereon regardless of whether or not said seal segments are in a sealing or non-sealing position with one another thereby creating in combination with said seal segments a closed chamber which functions as a secondary seal;

d. said end edge portions of said seal segments prior to receiving said compressive force being inclined outwardly upwardly.

12. A damper mechanism according to claim 11 wherein said seal door in closed position applies a predetermined constant static compressive force on said end edge portions of said seal segments, the application of said predetermined constant static compressive force providing self-adjustment of the positions of said seal segments in response to opposing forces developed by thermal, chemical or mechanical activities which distort the shape or positions of the seal segments.

13. A damper mechanism comprising:

a. first and second curved seal segments positioned in opposing back-to-back relationship;

b. a slide gate damper for sliding insertion between, and withdrawal from between, said curved seal segments;

c. arms extending in opposing directions from said slide gate and so positioned that when said gate is in its DOWN position when said slide gate is in sealing and abutting engagement with said seal segments, the ends of said arms impose a static compressive force on an end edge portion of each of said seal segments, said end edge portions of said seal segments prior to receiving said static compressive force extending in an inclined outward and upward direction.

14. A damper mechanism according to claim 13 wherein the predetermined constant static compressive force applied by the arms of said gate on the end edge portions of said seal segments tend to maintain said seal segments in an inward position in abuttment against said gate thereby to provide self-adjustment of the positions of said seal segments in response to distortion forces generated by thermal, chemical or mechanical activities.

15. A damper mechanism for a flue duct comprising:

a. first and second curved seal segments of resilient material positioned in opposing back-to-back relationship;

b. a slide gate adapted for sliding insertion between and withdrawal from between, said curved seal segments;

c. a seal door pivotally mounted adjacent said first seal segment and positioned for pivotal movement to closed position;

d. means for opening and closing said seal door pivotally;

e. means for adjusting said opening and closing means to open said door at a sufficiently slow rate to a certain position to provide a clear path for the slide gate during normal lowering of said gate but insufficient to clear the gate path during free fall of said gate during the slow rate movement of said door;

f. said door being constructed of sufficient strength to absorb the force of a free falling gate and to interrupt the free fall to prevent said gate from crashing through and beyond the flue duct.

* * * * *